United States Patent [19]

Warczak

[11] 4,135,677

[45] Jan. 23, 1979

[54] PNEUMATIC SHAFTS, CHUCKS AND LIFTS FOR ROLL STOCK

[75] Inventor: Russell C. Warczak, Downers Grove, Ill.

[73] Assignee: Cedco, Inc., Bensenville, Ill.

[21] Appl. No.: 815,593

[22] Filed: Jul. 14, 1977

[51] Int. Cl.[2] ..... B65H 75/24; B21B 31/32

[52] U.S. Cl. ..... 242/72 B; 29/113 R

[58] Field of Search ..... 242/72 B, 110.1; 29/113 R, 113 AD; 279/2 A

[56] References Cited

U.S. PATENT DOCUMENTS

| | | | |
|---|---|---|---|
| 2,331,743 | 10/1943 | Sullivan | 29/113 R |
| 2,711,863 | 6/1955 | Grettve | 242/72 B |
| 3,104,074 | 9/1963 | Karr | 29/113 R |
| 3,253,323 | 5/1966 | Saueressig | 279/2 A |
| 3,863,857 | 2/1975 | Smith | 242/72 B |
| 3,904,144 | 9/1975 | Gattrugeri | 279/2 A |

*Primary Examiner*—Edward J. McCarthy

*Attorney, Agent, or Firm*—Dulin, Thienpont, Potthast & Snyder, Ltd.

[57] ABSTRACT

Improved pneumatic shafts, chucks and lifts for roll stock and methods of construction and operation comprising an air bladder housed within a pair of concentrically disposed, longitudinally slotted sleeves. Upon inflation of the bladder, the outer sleeve expands against the roll stock, or the core supporting the roll stock, providing full length grip. The inner sleeve expands against the outer sleeve while protecting the bladder from being pinched. The bladder is preferably a vinyl polymer plastic containing substantially inelastic roving to provide controlled and limited expansion. The combination permits true centering of rolls for rotational balance and constant tension, true running.

29 Claims, 10 Drawing Figures

FIG. 6a
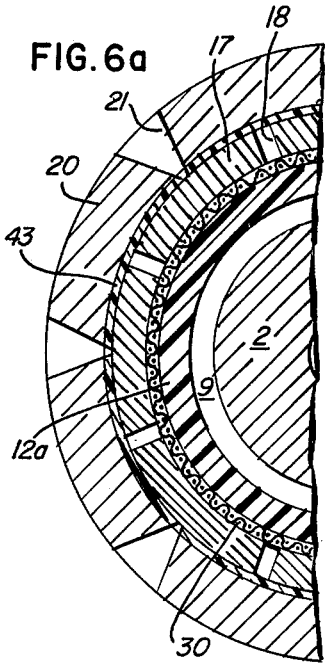
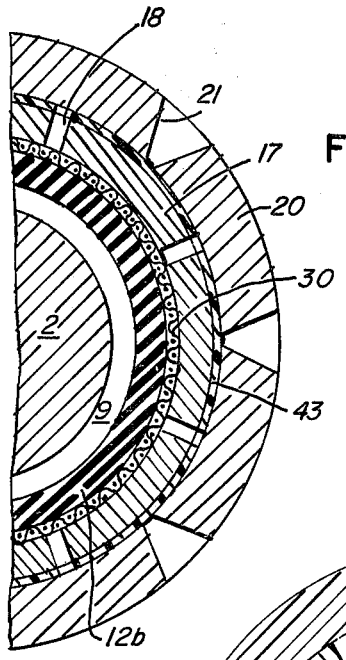
FIG. 6b
FIG. 7
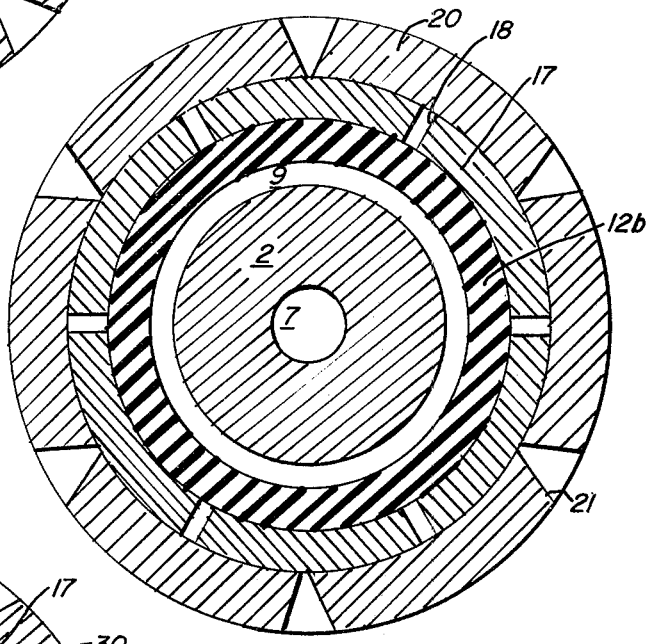
FIG. 8a
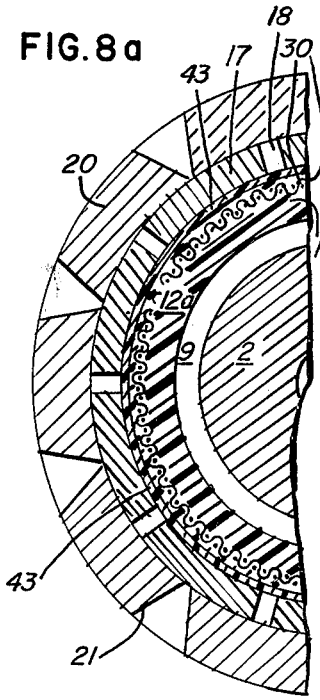
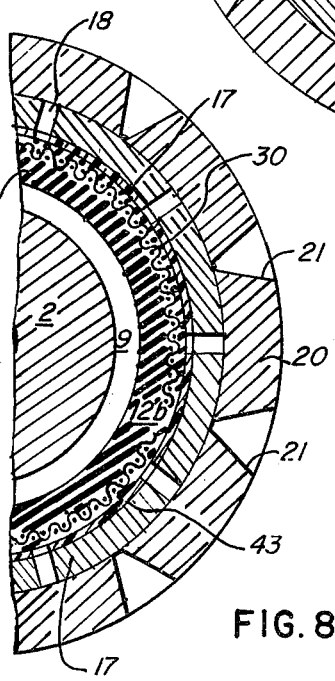
FIG. 8b

PNEUMATIC SHAFTS, CHUCKS AND LIFTS FOR ROLL STOCK

FIELD OF THE INVENTION

The invention relates to improved, expansible pneumatic mandrels (air shafts) and pneumatic chucks and lifts used to support roll stock, such as paper, film, foil, filaments, fibers, woven and non-woven materials. More particularly, the invention relates to apparatus and methods of manufacture and use of air shafts used in the converting, paper making, or continuous web feed printing or processing industries. The air shafts have a simple and improved construction including a pair of longitudinally slotted sleeves and a limited expansion, roving reinforced pneumatic pressure bladder, which in combination permit true centering of the roll for rotational balance and constant tension, true running.

BACKGROUND

Pneumatic mandrels and chucks, the latter including shaftless and core-bar mounted chucks, have come into prominent use in the roll handling field within the past twenty years. Typically these mandrels are inserted into the cores of roll stock, e.g. a paper, plastic, woven or non-woven web of material, and expanded to grip the inner surface of the cores by application of compressed air to a neoprene or rubber bladder internal of the mandrel. The elastic bladder expands against leaves, lugs or buttons which move radially outward to grip the inner surface of the core, or the web stock itself when no core is used. A good orientation into the types of expandable air shafts can be found in "The ABCs of Expandable Air Shafts" by Stephen H. Albee, Graphic Arts Monthly, April 1977, pp 52–56. The October 1975 issue of Paper, Film & Foil Converter on pp 52, 66, and 93 describes generally the products of Nim-Cor, Inc., Tidland Corp., and Double E Company, Inc., all manufacturers of various types of air shafts.

There are five basic types of air shafts: Leaf (movable, one fixed, and trapper leaf); Large Button; Small Button; Lug; and C-shaped dual Fiberglass Sleeve type. There are numerous specialty styles including slitter knife and square shaft types. As stated in the Albee article, p 52: "Whatever the style, all air shafts share one basic principle. A metal tubular body acts as the load-carrying member. This shaft contains a number of drilled holes or slots into which are fitted metal buttons or lugs backed with steel pressure flanges. When air is injected into the shaft, an internal air bladder expands, forcing the buttons or lugs radially outward until they securely grip the inside diameter of the roll core along its full length.

"The internal air bladder, made of tear-resistant neoprene or similar material, has bonded ends or metal fittings that form an airtight flexible chamber. Air pressure of approximately 80 lbs. per sq. in. is necessary to ensure that the outward thrust of the buttons is sufficient to grip the core properly.

"When the air is released, the bladder deflates, causing the spring-loaded buttons or lugs to retract below the outside surface of the shaft. This allows quick and easy removal of the shaft from the roll."

Atlo Tool and Engineering offers an "Equalizer" brand air shaft having four conventional outer leaves mounted on pusher pins extending through the tubular main body of the shaft. An inner rubber tube (bladder) exerts pressure on inner leaves which are connected to the outer leaves by pusher pins. This construction is claimed to prevent eccentric chucking due to a spring between the pusher pin and inner leaf, and the limited travel of the inner leaf which is due to special marginal edges which contact the inner surface of the main body. The Western Tool and Manufacturing Co., Inc. provides a Patton AeroShaft having a single longitudinal fluted rib which expands to grip the core.

The leaf, button and lug type air shafts are all relatively complex, requiring many internal, linked, moving parts with spring return, pusher pins, screw connections and the like. The rubber bladder deteriorates with age and is subject to blow-outs. Further, since it will preferentially expand where it is not confined, rubber bellows tend to cause the shafts to grip the roll cores off center axis. This is because those leaves, lugs, buttons or sleeves that touch the core first in one area tend to offer greater resistance to bladder expansion as compared to other expanding leaves, which expand till they meet equal resistance. Since the shaft is typically inserted in roll cores off axis to start, true centering and rotational balance is often not achieved.

As the rolls turn, they start to work up and down on the shaft, gradually becoming loose. Vibration and pulsation cause variation in web tension. In turn, this causes loss of product quality and, quite often, breakage of the web stock. The complex leaf mechanisms can get jammed during shaft flexing, the springs break, and the internals can collect paper dust and waste. In addition to high initial cost, the maintenance downtime and cost can be considerable. To this must be added the cost of slippages, stock jamming in presses, loss of tension control and waste left on the rolls.

The fiberglass sleeved shafts are basically a variation of the leaf type in which two generally C-shaped fiberglass sleeves are used in lieu of leaves and in conjunction with a high tensile aluminum shaft body. The fiberglass outer sleeve has a zig-zag gap which opens to accommodate the expansion of the rubber inflating element and smooth-surfaced inner sleeve. This type of shaft is used primarily only where low handling weight is of prime importance.

Accordingly there is a need for a simple, pneumatic air shaft that provides full grip along its length, has a high strength to weight ratio, is able to handle the high speed and heavy load conditions of today's web processing equipment, offers true centering for rotational balance, non-eccentric rotation, and even tension control, is relatively low cost, and is easy, simple and faster to maintain.

THE INVENTION

Objects

It is among the objects of this invention to provide improved pneumatic mandrels and chucks which are simple of construction and easy to maintain.

It is another object to provide new type air shafts, chucks and roll lifts of a new, expandable, slotted-sleeve type which achieves the needs of the industry.

It is another object to provide improved pneumatic mandrels and chucks having limited expansibility bladders with fiber or braided roving reinforcement therein.

It is another object to provide improved air shafts and chucks having slotted sleeves that, by their construction, have a self-contained spring action yet contain no springs that can break and puncture the air bladder.

It is another object to provide improved air chucks and mandrels that have simple assemblies for the air bladder member.

It is another object to provide pneumatic mandrels, chucks, and roll lifts, and methods of construction and use thereof which show improved centering characteristics, have high strength to weight ratios resulting in minimum deflection at high critical speeds, that have rugged and heavy duty construction, that are simple to manufacture, use and maintain, that reduce eccentric running, vibration, web tension pulsation, slippage, compacting, jamming, waste roll stock, and have full grip along the length.

Still other objects will be evident from the description and drawings.

Figures

The drawings illustrate principles of the invention in which.

Figure 1:
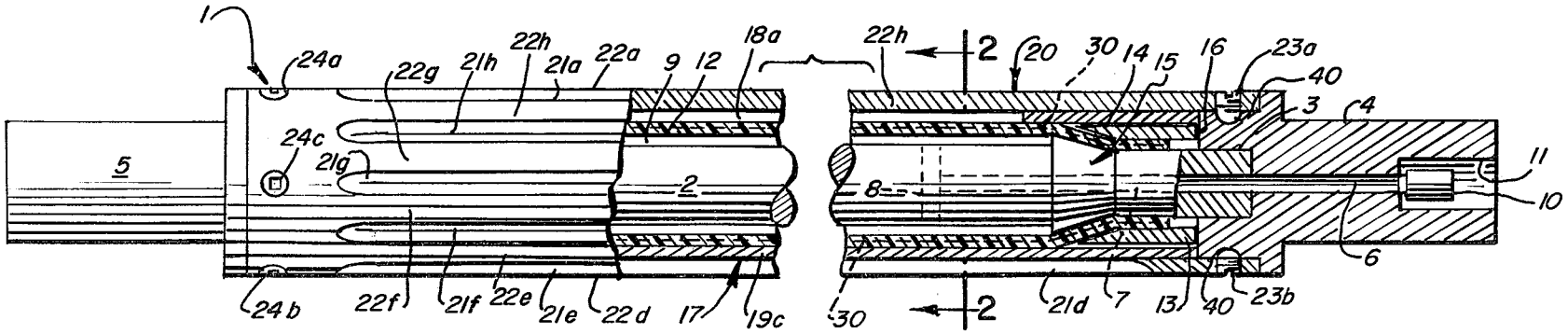
FIG. 1 is a plan view, partly in section of an improved air shaft of this invention.

FIGS. 6*a* and 6*b* are partial section views of air shafts of this invention showing alternative embodiments employing a roving tube over a bladder tube, and a teflon layer between mating sleeve surfaces;

FIG. 7 is a section view of the dual slotted sleeve air shaft aspect of the invention employing a conventional-type rubber or neoprene bladder; and FIGS. 8*a* and 8*b* are partial cross sections through air shafts of this invention showing alternative embodiments in which a roving is laminated or impregnated into the exterior surface of a bladder tube.

SUMMARY

The improved mandrels, chucks and roll lifts of this invention are characterized by a center support shaft which is received in an end journal (for chucks and roll lifts) or a pair thereof for the air shafts. The shaft has an air supply channel provided therein, which is connected to an air check valve at the journal end.

Spaced outwardly from the shaft is an air bladder, comprising a plastic, preferably vinyl, tubing having fibrous, woven or braided roving. An important aspect of the preferred embodiment is that the bladder has limited expansibility. This is due to the use of relatively inelastic vinyl, and, optionally, to use of roving embedded therein. The bladder may be any cylindrical tubing having the requisite properties of limited expansibility described herein. Preferably, however, the bladder has a corrugated or polygonal cross-section. For the polygonal cross-section embodiment, the number of sides of the bladder correspond to the number of slots in the inner expander sleeve. The vertices of the adjoining polygonal sides are oriented to contact the inner wall of the inner expander sleeve between adjacent slots, i.e. the vertices do not align with the slots. This is to prevent pinching of the bladder by the slots.

The roving is preferably embedded in the bladder, but may be laminated thereto, may be impregnated into the outer surface thereof, or may be a separate sleeve fitting over the bladder tube. To assist in expansion movement against the inner wall of the inner sleeve, the outer surface of the bladder may be coated with teflon (Tetrafluoroethylene), Kel-F (trichlorofluoroethylene or triflurochloroethylene), or FEP (fluorinated ethylene-propylene) polymers. Likewise the one or more of the mating inner surface of the outer sleeve, or outer surface of the inner sleeve may have a suitable low friction coating.

Fitted over the bladder are a pair of tubular sleeves, preferably cylindrical. The first is a relatively thin, mild steel, inner protective and expandable sleeve, into which are milled or cut slots. The slot ends are spaced medially from each end of the sleeve. These slots are continuous, preferably longitudinally straight slots, which may have straight (square cut) or tapered sides. Overlying and in contact with the first protective sleeve is the second, outer sleeve. It is a thicker, mild steel, slotted, roll-gripping sleeve. Slots are milled through the second sleeve, which slots commence and terminate medial of the sleeve ends. These slots are straight slots, but preferably have tapered sides so the external appearance is one of V-grooves. The outer and inner sleeve slots are staggered so that they do not align. One or both sleeves may be secured to each journal end. In the air shaft embodiment the journal ends receivingly engage the center support shaft medially therebetween.

An important aspect of the invention is that the dual slotted sleeve assembly permits the use of conventional expansible-type bladders such as neoprene or rubber. While the use of limited expansibility tubing (e.g. vinyl alone or with roving embedded, laminated, or overlying the bladder tube) is preferred, the limited expansibility feature may be omitted, and a conventional by expandable rubber or neoprene bladder may be used, albeit care in use must be observed.

The bladder may be sealed to the shaft in a number of ways. In a first embodiment, a tapered collar compresses the end of the bladder tubing against a mating shoulder to effect the seal. The collar is held in place by the journal end and sleeves. In another embodiment, an O-ring is fitted in a groove in the center support shaft or the journal end. The bladder tube fits thereover, and is sealingly compressed by the sleeves mounted exteriorly thereof.

This construction has many advantages. It is simple, involving no mechanical linkages, separate spring parts, leaves, lugs, or buttons. It has a high strength to weight ratio. As the bladder is inflated, the slotted sleeves expand, with the outer sleeve contacting the roll web or core securely. Due to the limited expansibility of the bladder, it cannot overinflate in one radial direction or longitudinal area, thus helping to prevent eccentric chucking. As it inflates, and the ribs expand, since the ends of the sleeves are secured to the journal ends or center shaft, the roll is chucked horizontally (axially) more tightly since the journal ends are drawn inwardly (medially).

While we do not wish to be bound by theory, it is thought that the shaft of this invention is stronger since the entire assembly is put under axial compressive tension. Ordinarily, in prior art shaft, the addition of the weight of a 2,000 or 3,000 lb. roll causes considerable shaft deflection. In this assembly, when the bladder is inflated, the sleeves in expanding put compressive tension on the shaft, being secured at each end thereto. In this condition the shaft is better able to resist flexing.

The air shafts of this invention are self centering due to the limited expansibility feature and the slotted sleeve construction. This promotes true running, with less vibration and little tendency for the roll to work loose.

As the outer sleeve expands, it becomes more polygonal in cross-section. Each rib of the outer expander sleeve "bites" into the roll webstock or core, providing a full grip along its length.

DETAILED DESCRIPTION

Further detailed description of the inventions, by way of example and not by way of limitation, will be made with reference to the drawings, in which like parts are identified with like numerals.

Turning to FIG. 1, air shaft 1 comprises center support shaft 2, one end of which is receivingly engaged in socket recess 3 in journal end piece 4. Similarly the other end of the center support shaft is received in journal end 5. Axial air supply channel 6 in journal 4 is aligned with channel 7 in shaft 2. The air supply channel 7 terminates in a T-shaped supply duct 8 which communicates with air space 9. Air or other gas is supplied for inflation pressure via check valve 10 in journal recess 11.

Figure 5:
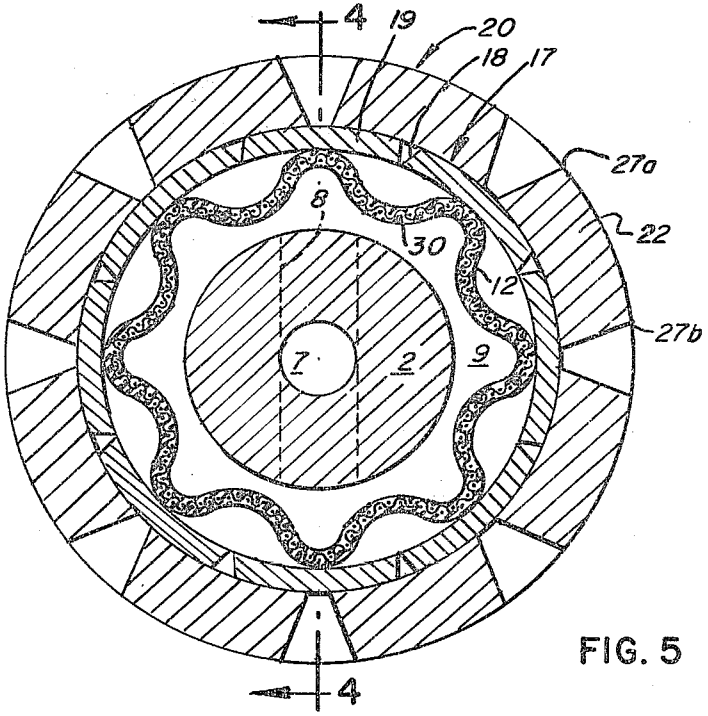
FIG. 5 is a section view of the air shaft of FIG. 4 taken along lines 4—4 of FIG. 4.

Tubular bladder 12 is sealed to shaft 2 by sealing ring 13. As shown, the tapered forward end 14 of the sealing ring is urged into sealing engagement with the bladder and mating tapered shoulder 15 of the shaft 2 by shoulder 16 on the medial end of the journal 4. An alternative sealing mode is to provide ring 13 with a longitudinal split, so that it is C-shaped and slightly larger than the O.D. of the bladder tube. In this configuration the ring clamps the bladder when compressed thereonto by the sleeves which fit thereover. Another sealing configuration is shown in FIG. 5.

Figure 2:
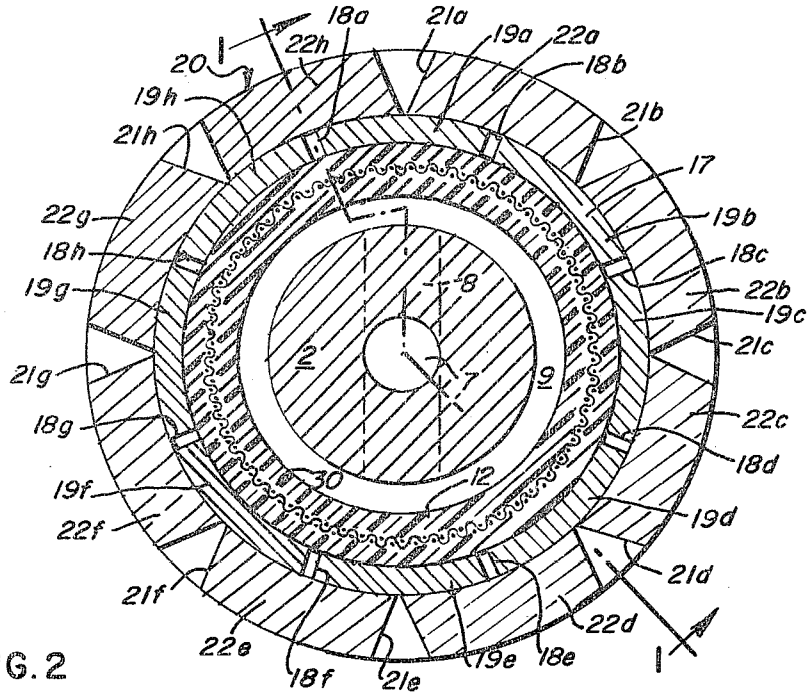
FIG. 2 is a section view of the shaft assembly of FIG. 1 taken along lines 2—2 of FIG. 1.

Overlying the bladder is a first, inner protective and expandable sleeve 17. This sleeve may be made of any resilient, strong material; we presently prefer a mild steel but the stronger plastics (e.g. polycarbonate, fiberglass, ABS, etc) or light metals (aluminum, titanium, alloys) may be used. This inner sleeve has plural slots spaced equally around the circumference extending axially (parallel to the center axis of the shaft). The slots are medial slots, that is, they commence and end medially of the ends of the sleeve 17. As best seen in FIG. 2, slots 18*a* through *h* are spaced equally around the sleeve and extend completely through it. The slots may be milled into the tubular sleeve, or the sleeve may be built up of a pair of end rings joined by plural longitudinal strips 19*a–h*.

Overlying the first, inner sleeve is a second, outer slotted sleeve 20, which is thicker and may also be of the same material, but is preferably mild steel. The outer sleeve has a series of V-grooved slots 21*a–h* milled therethrough as best seen in FIG. 2. FIG. 2 also demonstrates that the outer sleeve slots 21*a–h* are angularly staggered with respect to the inner sleeve slots 18. In this manner paper dust is prevented from working between the bladder and inner sleeve, and the bladder does not become pinched in slots. Also, parts of two inner sleeve strips push radially outwardly on each outer sleeve rib 22*a–h* when the bladder is expanded. The outer sleeve is fastened to the journal end 4 by a series of cup point set screws which bear on dog points, two of which screws 23*a* and *b* are shown. Likewise the other end of the outer sleeve is secured by set screws 24*a, b, c* as shown in FIG. 1.

Figure 3:
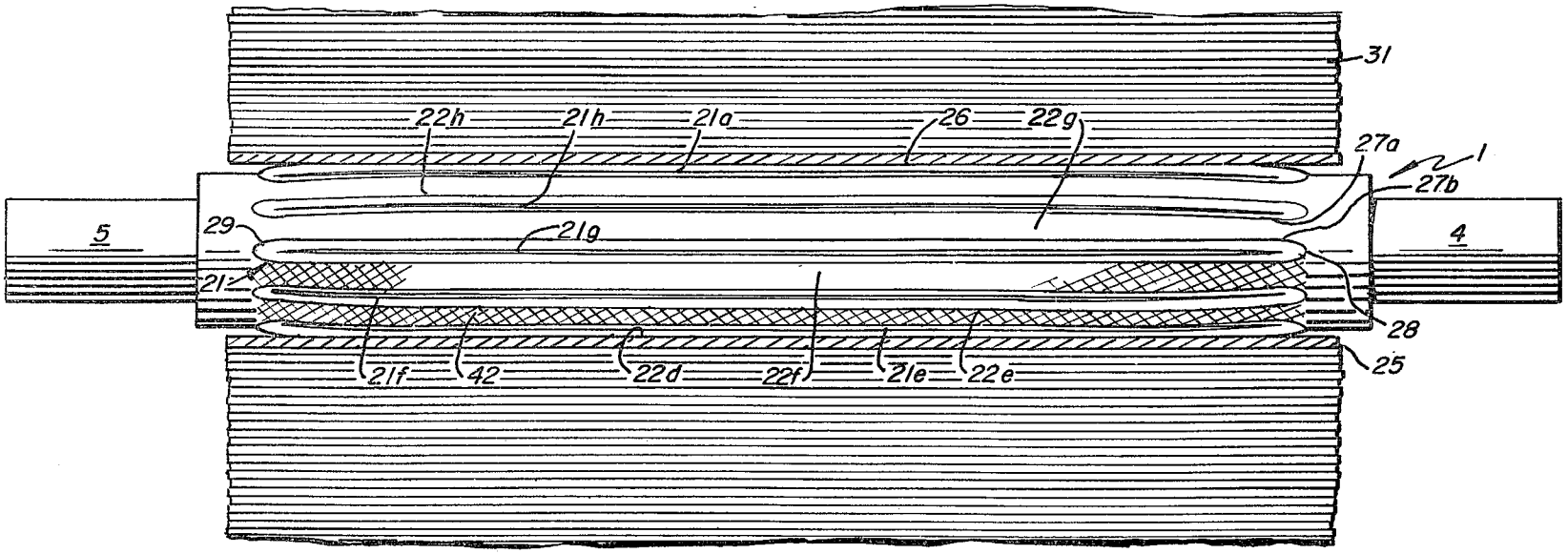
FIG. 3 shows a plan view of one embodiment of a shaft of the invention in use showing full grip in an expanded condition inserted in roll stock.

Referring now to FIG. 3, this is a plan view of the pneumatic mandrels of the present invention illustrating the expansion feature. In operation, the air shaft 1 is inserted in the center of roll stock 31, such as core 25 shown in FIG. 3. A source of high pressure air or other gas, not shown, is placed on the air check valve, and the bladder is inflated to from 60 to 120 psi. The bladder exerts outward pressure uniformly on the inner expandable sleeve. Due to the longitudinal slits in the inner sleeve, the strips 19*a–h* expand outwardly, uniformly exerting radially outward force on the outer, slotted sleeve ribs 22*a–h*. In turn, the outer sleeve also expands, due to its rib-slot construction, coming into contact with and gripping the internal surface 26 of the roll stock or core 25. As best seen in FIG. 3, there is extensive longitudinal surface contact between the expanding ribs and the inner surface 26 of the core 25. It should also be noted that the two longitudinal edges of each rib, for example edges 27*a* and 27*b* of rib 22 shown in FIG. 3, dig into the inner core surface to assist in preventing roll slippage. It should be appreciated that as the outer core expands, the configuration changes from round to slightly polygonal with each of the rib edges forming a shoulder which presses into the roll core stock.

As shown in FIG. 3, the ribs are shorter in length than the length of the roll stock core. However, the ribs and shaft can be longer than the roll stock core width. Thus, multiple rolls can be mounted on the same shaft with the terminal ends 28, 29 of the V-grooved slots 21 being either internal or external of the roll stock core ends.

The shaft has limited expansion due to the limited expansibility of the inner tubular bladder, and the resiliency of the inner and outer sleeves. Thus, the bladder cannot overexpand and blow up should the shaft be expanded freely without being first inserted into a roll stock core. The limited expansibility of the bladder is due in part to its nature being a low expansibility plastic or rubber, and also that it may optionally contain reinforcing roving 30 as best seen in FIGS. 2, 5, 6 and 8. For example, the bladder can be 3/32" thick vinyl used alone, or optionally containing nylon fibers or brading as shown in phantom in FIGS. 1 and 3 as item 30. Another alternative is a polyvinyl chloride tubing containing a high tenacity polyvinyl acetate yarn embedded therein. In another embodiment, a two-ply assembly can be used, in which the inner ply comprises a plastic or rubber tubing which is overlain by a tubular braiding or rowing of plastic, natural fibers, metal or fiberglass. The two layers may be laminated together or may be close-fitting concentric tubes.

It should be understood that while it is preferred that the bladder has limited expansibility, it is possible to use a conventional high expansibility rubber bladder in conjunction with the inner and outer slotted sleeve arrangement. Similarly, the principles of this invention involve using the special limited expansibility bladder assembly of this invention with conventional leaf, lug, button or plural fiberglass sleeve types of air shaft as described above in the Background of the invention. A safety feature of the air shaft of this invention resides in the fact that as the roll stock is unwound from the mounted shaft, in cases where the roll stock is coreless, there is no chance for the bladder to overexpand or explode as the pressure is released from the shaft.

In addition, it should also be noted that the air shaft in the expanded condition can be cleaned of paper dust by an air jet directed along the V-grooves. Any paper dust which may have accumulated is blown out. Thereafter the shaft can be deflated for reuse.

When the air shaft is desired to be removed from the roll stock core, the air is bled from the air check valve 10 (see FIG. 1). Due to the natural resilience of the metal or plastic material of the slotted sleeves, they return to their normal unexpanded position as shown in FIGS. 1 and 2 thus expelling air from the bladder. The shaft can then be removed easily from the core. It should be noted that an important aspect of the invention is that there are no additional spring parts which can break in operation thereby puncturing the bladder. The ribs of the outer sleeve and strips of the inner sleeve themselves act as springs due to the slotted construction of the sleeves. They act not only as contact surfaces, but also as springs. There has effectively been elimination of parts yet function has been retained.

Figure 4:
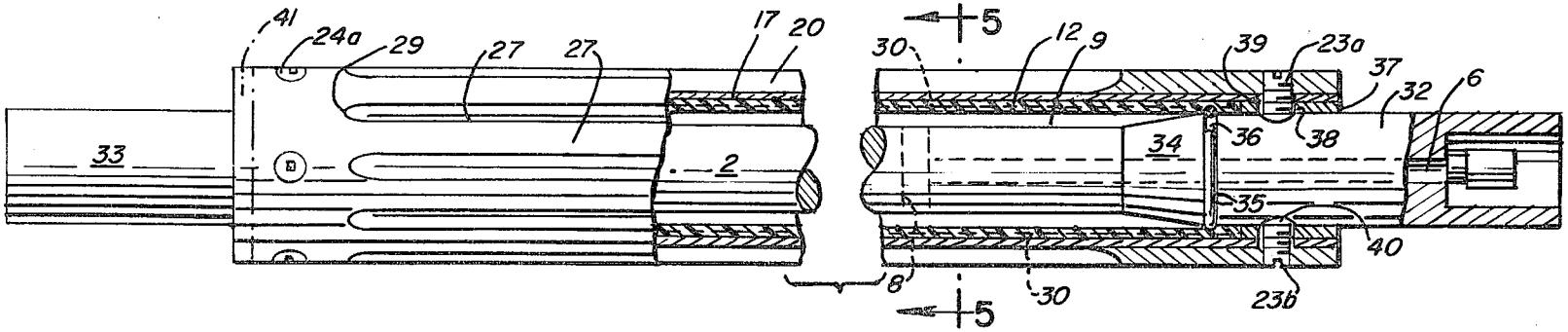
FIG. 4 is another embodiment of the air shafts of this invention with an O-ring seal assembly.

FIG. 4 illustrates still another embodiment of the air shafts of this invention. In this embodiment, central shaft 2 includes its own integral journal end portions 32, 33. It also has the supply ducts as in the example of FIG. 1. The central shaft has a tapered neck portion 34 which provides air space 9 between it and the bladder 12. In this embodiment, the inner sleeve 17 and the outer sleeve 20 are of equal length. The bladder terminates short of the sleeve length to provide room for a C-shaped spacer end ring 37. The C-shaped spacer end ring and the inner sleeve contain mating holes 39, 40 respectively, which are oversized with respect to the corresponding set screw 23. As before, the set screw is the cup point type that is set into the dog point provided in the surface of the shaft. This embodiment works in operation in a manner similar to that of the embodiment shown in FIGS. 1 and 2.

FIG. 5 is a section through line 4—4 of FIG. 4. This shows the use of a corrugated or polygonal configuration for the bladder tubing 12. This assists in preventing any pinching of the bladder by the slots in the inner sleeve 18 during expansion or contraction of the assembly.

In regard to air chucks or lifts, a similar construction is employed. In one embodiment, a journal end such as 4 shown in FIG. 1 may be used with or without a central shaft that would terminate with a flat plate at the other end of the assembly. We prefer however using a solid shaft as in FIG. 4 which would terminate in a flat endplate (shown as element 41 in phantom in FIG. 4). The solid shaft would provide adequate lift strength capability. It should be understood that for chucks and roll lifts, the length of the device is far less than that for a full length roll stock shaft. The chucks may be inserted, one from each end of the roll stock, and they are typically on the order of 6 to 12 inches in length. The shafts run the full length of the rolls. The roll lifts are typically intermediate in length.

The outer surface of outer slotted sleeve 20 may be knurled or grooved, along part or all of its length, as at 42 in FIG. 3, to improve grip. The outer surface of inner sleeve 17 or the inner surface of outer sleeve 20 may be coated with low friction material such as polytetrafluoroethylene ("Teflon") or polyfluorotrichloroethylene ("Kel-F") to reduce any frictional binding with might occur during expansion and contraction. Similarly, the internal surface of inner sleeve 17 or the outer surface of bladder 14 may be low-friction coated.

EXAMPLE

A 3" O.D. (nominal) air shaft in accordance with our invention has an actual diameter of between 2⅞" and 2 15/16". The bladder is 2" O.D. and is made of 3/32" thick polyvinyl chloride tubing containing high tenacity polyvinyl acetate yarn roving. The inner sleeve is a 1/16" mild steel tubing with 1/16" wide grooves milled therethrough. Eight grooves are milled to provide effectively an 8-strip inner sleeve. The outer sleeve is ⅜" mild steel which has V-grooves milled therethrough. In this example, and as shown in FIG. 2, 8 V-grooves are employed. The shaft is assembled with the inner sleeve slots and the outer sleeve V-grooves being angularly offset. The center shaft has a 1½" O.D., leaving a ⅛" air space. The assembly is inserted into a standard paper roll stock having a standard 3" I.D. steel or cardboard core. The roll weighs approximately 3,000 lbs. The bladder is inflated to 100 psi, and during inflation it can be seen that the shaft centers itself in the roll stock core, and the core is actually lifted by the inflation pressure. In actual running, improved true running characteristics are observed. Vibration and web tension pulsation is substantially eliminated. The shaft is simpler to manufacture, simpler to operate, and has essentially no breakable parts, yet the total overall performance is improved.

Turning now to FIGS. 6*a* and 6*b*, these embodiments show the use of a roving tube 30 overlying, but not attached to the bladder 12. In FIG. 6*a* the bladder 12*a* is shown as a plastic material such as vinyl, while in FIG. 6*b* the bladder 12*b* is shown as an expansible rubber or neoprene. These figures also show the use of a low friction layer 43 which may be a sleeve sized to fit inner sleeve 17. Preferably the low friction layer 43 is bonded to either the outer surface of inner sleeve 17 or the inner surface of outer sleeve 20. The low friction layer may be of Teflon, Kel-F, Halon, FEP or the like, or it may comprise any low friction surface treatment for either inner sleeve 17 or outer sleeve 20, e.g. an oil impregnated surface layer of either sleeve. This layer assists in the movement of the inner sleeve strips against outer sleeve ribs on expansion and deflation.

FIG. 7 shows in cross section an air shaft, chucks or lifts of this invention having only six ribs and slots in the outer sleeve 20, and six strips and slots in the inner sleeve 17. It also shows the use of a conventional expansible-type rubber or neoprene bladder to inflate the structure.

FIGS. 8*a* and 8*b* are partial cross sections showing a ten slot construction in which the inner sleeve 17 has ten slots and strips angularly offset from ten V-grooves and ribs in the outer sleeve 20. The roving 30 in the embodiment is steel, and is impregnated into the outer surface of the bladder tube 12. In FIG. 8*a* the bladder tube is vinyl, while in FIG. 8*b* the bladder tube is rubber or neoprene. Optional low friction layer 43 may be on the outer surface of the bladder or inner surface of inner sleeve 17.

It should be understood that various modifications within the scope of this invention can be made by one of ordinary skill in the art without departing from the spirit thereof. I therefore wish my invention to be defined by the scope of the appended claims as broadly as the prior art will permit, and in view of this specification if need be.

I claim:

1. In pneumatic, roll handling devices of the air shaft, chuck and roll lift types having a pneumatic bladder and means for expansibly contacting roll stock and cores, the improvement which comprises a limited expansion bladder member assembly disposed internally thereof to actuate said expansible contacting means.

2. The improved bladder of claim 1 wherein said bladder expansion is limited by filamentous material selected from being embedded in, laminated to, and overlying a flexible resilient bladder member, and combinations thereof.

3. The improved bladder of claim 2 wherein said resilient member includes a vinyl polymeric compound.

4. The improved bladder of claim 3 wherein said filamentous material is roving embedded in said vinyl member.

5. The improved bladder of claim 2 wherein said filamentous material is selected from metal, glass fibers, plastic fibers, natural fibers, and combinations thereof.

6. The improved bladder of claim 2 wherein the outer surface of said bladder member assembly is coated with low friction material.

7. The improved bladder of claim 2 in which said expansion means is selected from the group consisting essentially of leaves, buttons, lugs, fiberglass sleeves, and longitudinally slotted sleeves.

8. A pneumatic, roll handling device of the air shaft, chuck and roll lift type comprising in operative combination:

(a) a pneumatic bladder assembly;
(b) an inner, expandable tubular sleeve contactable by said bladder and disposed exteriorly of said bladder;
(c) an outer, expandable tubular sleeve, having an exterior surface for contacting roll stock and roll stock cores, disposed concentrically exteriorly of and in continuous contact with said inner sleeve;
(d) said inner and outer sleeve each having a plurality of longitudinal slots therethrough, said slots commencing and ending medially of the ends of said tubular sleeves;
(e) said slots in said sleeves are angularly displaced with respect to each other, and both sleeves have the same number of slots; and
(f) means for inflating said bladder assembly.

9. A roll handling device as in claim 8 wherein said bladder is selected from a freely expansible material and a flexible, resilient material having limited expansion properties.

10. A roll handling device as in claim 9 wherein said expansible material is selected from neoprene and natural rubber.

11. A roll handling device as in claim 9 wherein said limited expansion bladder assembly comprises a resilient, flexible polymeric plastic member, the expansion of which is limited by filamentous material embedded in, laminated to, and overlying said plastic member, and combinations thereof.

12. A roll handling device as in claim 11 wherein said filamentous material is roving embedded in a vinyl plastic.

13. A roll handling device as in claim 11 wherein said filamentous material is selected from metal, glass fibers, plastic fibers, natural fibers, and combinations thereof.

14. A roll handling device as in claim 11 wherein the outer surface of said bladder assembly is coated with a low friction material.

15. A roll handling device as in claim 8 wherein the inner surface of said inner tubular sleeve is coated with a low friction material.

16. A roll handling device as in claim 8 wherein at least one of the surfaces of said sleeves in contact with the other of said sleeves is coated with a low friction material.

17. A roll handling device as in claim 8 wherein the outer slots are V-grooved in cross section.

18. A roll handling device as in claim 8 wherein the outer sleeve exterior surface is treated to enhance frictional gripping.

19. A roll handling device as in claim 8 wherein the sleeve material is selected from mild steel, aluminum, titanium, polycarbonate plastic, ABS plastic, and glass fiber reinforced plastic.

20. A roll handling device as in claim 8 wherein the pneumatic bladder is tubular and the cross section is selected from substantially circular, corrugated, and polygonal, the number of sides in the polygon corresponding to the number of slots in the inner sleeve.

21. A roll handling device as in claim 8 wherein said outer sleeve is secured at least at one end to a shaft member.

22. A roll handling device as in claim 21 wherein said bladder is tubular, and said shaft is a support shaft disposed centrally of said tubular bladder.

23. A roll handling device as in claim 22 wherein said shaft terminates at each end in journal end means to form an air shaft device.

24. An improved pneumatic mandrel comprising in operative combination:

(a) a support shaft having journalling means at each end thereof;
(b) a tubular bladder disposed concentrically around said shaft;
(c) means to seal said tubular bladder at each end thereof to said shaft, said bladder being longitudinally shorter than said shaft.
(d) means to supply a fluid to said bladder disposed in said shaft;
(e) a first, tubular inner slotted sleeve disposed exteriorly of said tubular bladder;
(f) a second tubular outer slotted sleeve disposed exteriorly and in contact with said inner sleeve;
(g) each of said sleeve's slots commencing and terminating medial of the ends of said sleeves, and said slots in the outer sleeve are angularly displaced with respect to inner sleeve slots; and
(h) said sleeves each are shorter than said shaft/journal means.

25. Improved pneumatic mandrel as in claim 24 wherein said tubular bladder is selected from an expansible material and a flexible assembly having limited expansion.

26. Improved pneumatic mandrel as in claim 25 therein said limited expansion bladder assembly comprises a resilient, flexible polymeric plastic member, the expansion of which is limited by filamentous material embedded in, laminated to, and overlying said plastic member, and combinations thereof.

27. Improved pneumatic mandrel as in claim 26 wherein said filamentous material is roving embedded in a vinyl plastic.

28. Improved pneumatic mandrel as in claim 27 wherein the pneumatic bladder is tubular and the cross section is selected from substantially circular, corrugated, and polygonal, the number of sides in the polygon corresponding to the number of slots in the inner sleeve.

29. Improved pneumatic mandrel as in claim 25 wherein the sleeve material is selected from mild steel, aluminum, titanium, polycarbonate plastic, ABS plastic, and glass fiber reinforced plastic.

* * * * *